US005357828A

United States Patent [19]

Spirer

[11] Patent Number: 5,357,828

[45] Date of Patent: Oct. 25, 1994

[54] FLUID OPERATED TOOL

[75] Inventor: Steven Spirer, Haworth, N.J.

[73] Assignee: Unex Corporation, South Hackensack, N.J.

[21] Appl. No.: 25,842

[22] Filed: Mar. 3, 1993

[51] Int. Cl.[5] ..... B25B 13/46

[52] U.S. Cl. ..... 81/57.39; 81/57.44

[58] Field of Search ..... 81/54, 55, 57.39, 57.4, 81/57.42, 57.44, 57.45, 57.46

[56] References Cited

U.S. PATENT DOCUMENTS 2,737,839 3/1956 Paget ..... 81/57.44 X 3,198,040 8/1965 Franck ..... 81/55

4,308,767 1/1982 Wilmeth ..... 81/57.39

*Primary Examiner*—D. S. Meislin

*Attorney, Agent, or Firm*—Michael J. Striker

[57] ABSTRACT

A fluid operated tool for tightening and loosening an element has a unit for clamping an element to be tightened or loosened, a unit for turning the element clamped by the clamping unit, and a fluid operated drive unit formed to act on the clamping unit and on the turning unit so that under the action of the fluid operated drive unit the clamping unit clamp the element and then the turning unit turn the clamped element.

6 Claims, 3 Drawing Sheets

FLUID OPERATED TOOL

BACKGROUND OF THE INVENTION

The present invention relates to fluid operated tools. Fluid operated tools are used for many purposes, including tightening and loosening various elements, such as for example, threaded connectors. For tightening or loosening an element it is necessary first to firmly engage it and then to apply a turning force so as to turn the element. In some instances the engagement is quite complicated, and it is necessary to reliably clamp the element first and then to turn it. It is therefore desirable to provide a tool which can perform reliable clamping of the element and then its turning as desired.

SUMMARY OF THE INVENTION

Accordingly, it is an object of the present invention to provide a fluid operated tool, which is formed to actively clamp an element and then to turn it for tightening or loosening.

In keeping with these objects and with others which will become apparent hereinafter, one feature of the present invention resides, briefly stated, in a fluid operated tool which has clamping means for clamping an element, turning means for turning an element, and a fluid operated drive which acts on the clamping means so that the clamping means clamps the element and then acts on the turning means so that the turning means turn the clamped element.

When the fluid operated tool is designed in accordance with the present invention, the single fluid operated drive provides for consecutively performed clamping and turning of the element to be tightened or loosened.

In accordance with an advantageous feature of the present invention, the fluid operated drive includes two fluid operated cylinder-piston units which correspondingly act on the clamping means and on the turning means, and the fluid communication is performed so that first the piston of one cylinder-piston unit acts on the clamping means to clamp the element and thereafter the piston of the other cylinder-piston unit acts on the turning means to turn the element after it has been clamped.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
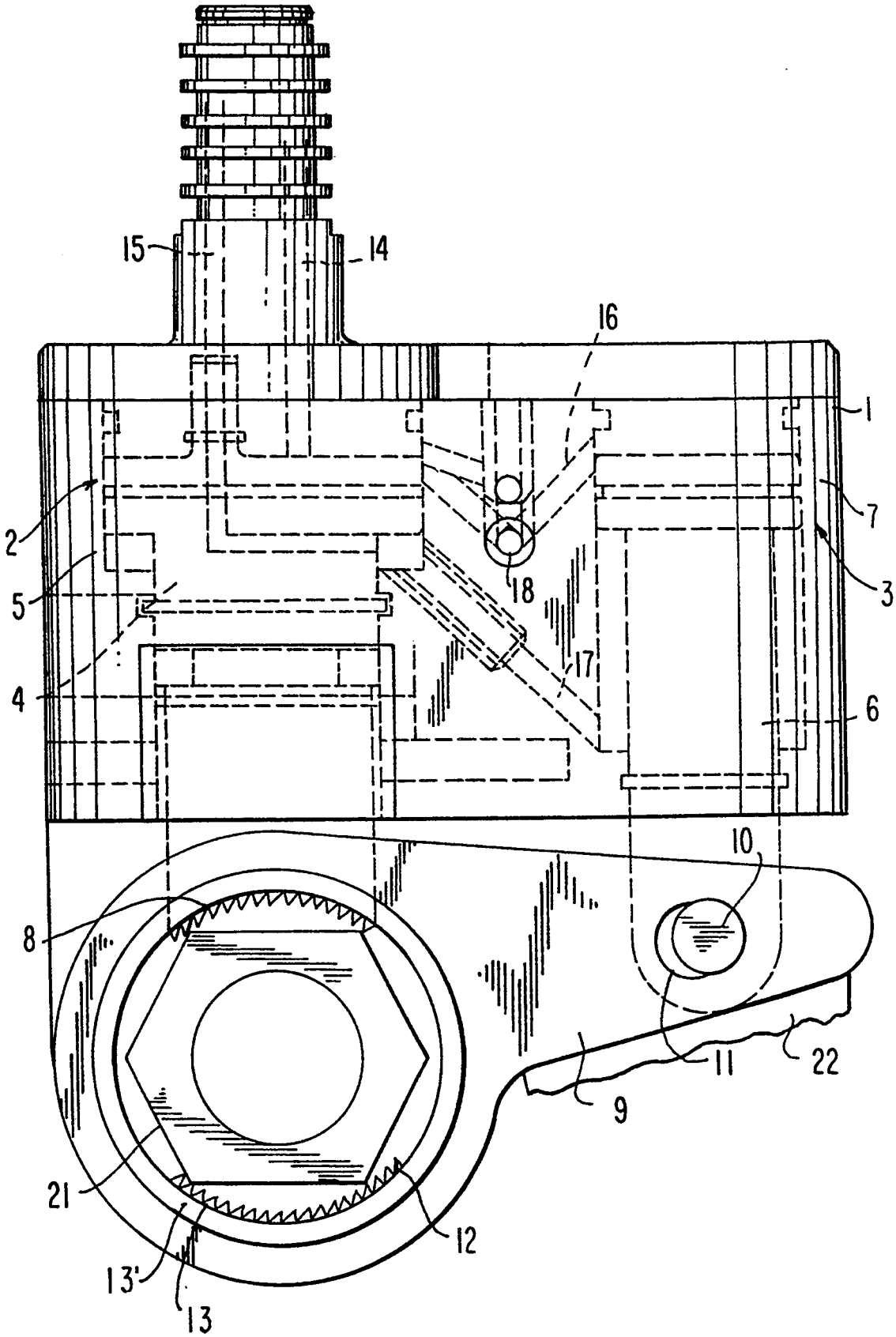
FIG. 1 is a front view of a fluid operated tool in accordance with the present invention.
Figure 2:
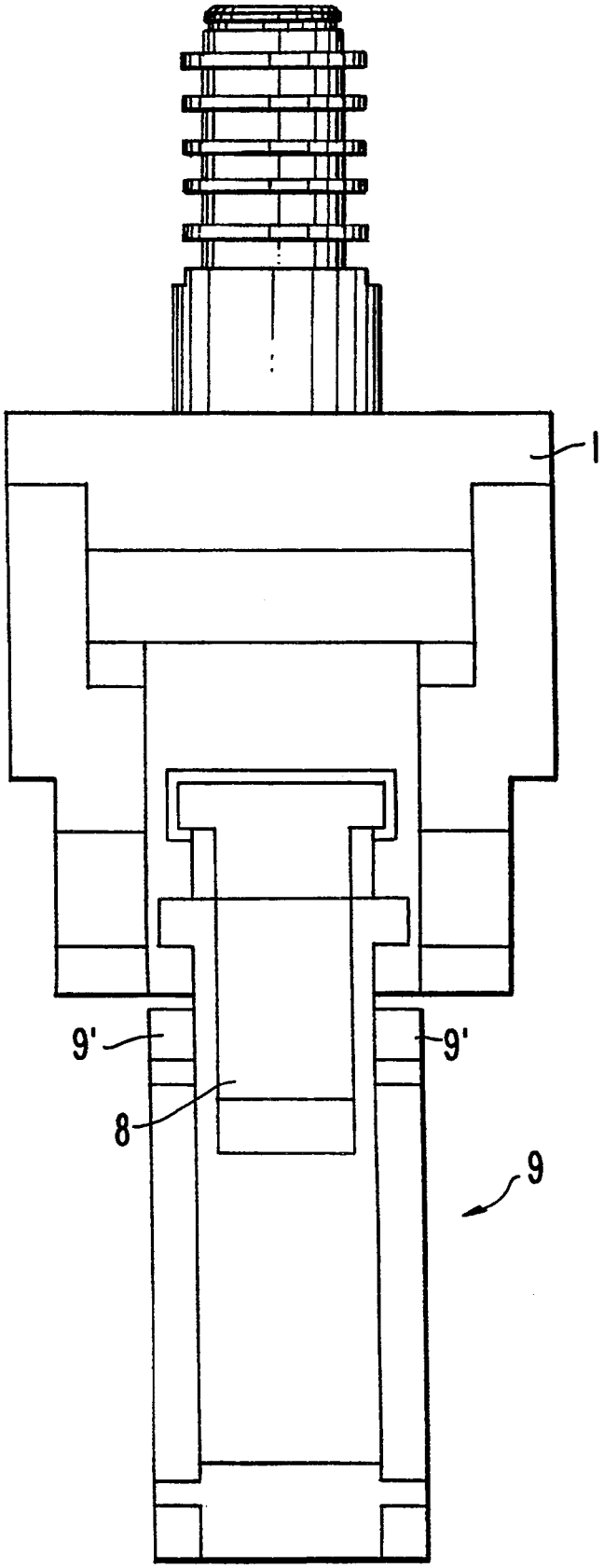
FIG. 2 is a side view of the inventive fluid operated tool.
Figure 3:
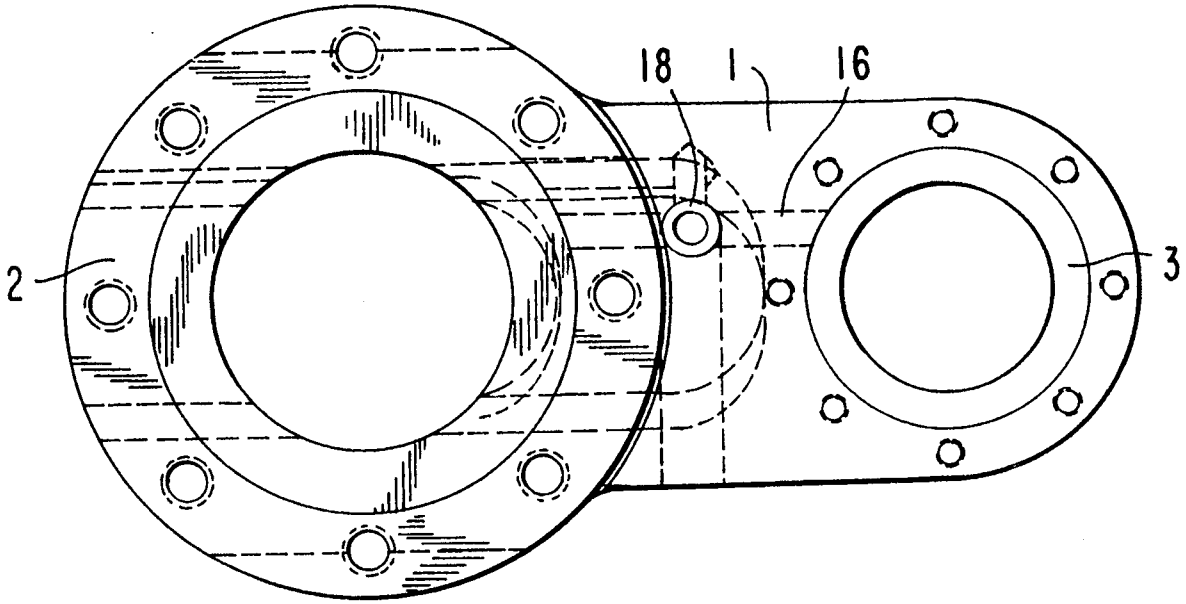
FIG. 3 is a plan view of the inventive fluid operated tool.

A fluid operated tool in accordance with the present invention is identified as a whole with reference numeral 1. The tool has a fluid operated drive which includes a first cylinder-piston unit 2 and a second cylinder-piston unit 3. A piston 4 moves in a cylinder 5 of the first cylinder-piston unit 2 while a piston 6 moves in the cylinder 7 of the second cylinder-piston unit 3. The cylinders can be formed directly in the housing 1.

The piston 4 of the first cylinder-piston unit 2 is provided with a clamping part 8 at its free end. The clamping part 8 can be formed by a plurality of teeth or other engaging formations formed directly on the surface of the free end of the piston 4. On the other hand, the clamping part 8 can be formed as a separate member provided with such teeth or formations and attached to the free end of the piston 4. The tool further has an arm 9 composed of two arm members 9' located at opposite sides of the central longitudinal plane A of the tool. One end of the arm 9 is pivotally connected with a free end of the piston 6 of the second cylinder-piston unit 3, for example by a pin 10. The pin 10 extends through an opening in the piston 6 and an elongated hole 11 in the arm 9 to provide a certain play between the arm 9 and the piston 6. The opposite end of the arm has a central opening 12 with a wall portion provided with a clamping part 13. A clamping part 13 is formed by a plurality of teeth which are provided on an inner surface of a ring 13' turnably arranged in the opening 12 of each arm member 9'.

A fluid-supply system for supplying a working fluid to the cylinder-piston units 2 and 3 includes an inlet passage 14 and an outlet passage 15 for supplying and withdrawing the working fluid to the fluid-operated drive as a whole. It further includes a passage 16 which communicates a working chamber of the cylinder-piston unit 2 with a working chamber of the cylinder-piston unit 3 for supplying the working fluid from the former to the latter, and a return passage 17 for withdrawing the working fluid from the cylinder-piston unit 3 to the cylinder-piston unit 2. The passage 16 contains a check valve or a similar element 18 which opens only when a predetermined pressure of the working fluid is reached.

The fluid operated tool in accordance with the present invention is used for turning an element 21 for its tightening or loosening, and during the operation can abut against a neighboring object 22 which can be for example a neighboring nut, bolt or other element.

The fluid operated tool in accordance with the present invention operates in the following manner:

For turning the element 21 in a predetermined direction, for example tightening the threaded element 21 in a threaded hole of a flange or the like, the tool is arranged so that the arm 9 is fitted on the element 21 so that the ring 13' surrounds the element 21 and the right portion of the arm 9 abuts against the neighboring object 22. Then the working fluid is supplied into the tool from a not shown fluid source and first flows into the cylinder-piston unit 2. Under the action of the working fluid, the piston 4 advances and the movable clamping part 8 moves toward the immovable clamping part 13. As a result, the element 21 is reliably clamped between the clamping parts 8 and 13. When a predetermined pressure is reached, the check valve 18 opens and the fluid is supplied from the cylinder-piston unit 2 into the cylinder-piston unit 3. Since the arm 9 abuts against the immovable object 22 and therefore the piston 6 cannot move, the working fluid acts on the surface of the working chamber of the cylinder-piston unit 3 in a direction which is opposite to the piston 6 and as a result turns the housing 1 by a reaction force in a counterclockwise direction in the drawing. The clamping part 8 also is turned in the counterclockwise direction and turns the element 21 so as to tighten or loosen the latter.

One of the important features of the present invention is that first the cylinder-piston unit 2 is actuated to first clamp the element 21, and only thereafter the cylinder-piston unit 3 is actuated to turn the element 21. While in the above described embodiment this is achieved by the valve 18 adjusted to a predetermined pressure which has to be exceeded before actuating of the cylinder-piston unit 3, the same results can be achieved in a different way. For example a sensor can be arranged so as to sense the clamping force obtained during clamping of the part 21, and when a certain clamping force has been obtained, the sensor gives a signal to a valve arranged in the passage 16 so as to open the passage 16 and to actuate the cylinder-piston unit 3 for turning the element 21. Also, other ways of achieving the same results are possible as well.

It will be understood that each of the elements described above, or two or more together, may also find a useful application in other types of constructions differing from the types described above.

While the invention has been illustrated and described as embodied in a fluid operated too, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fluid operated tool for tightening and loosening an element, comprising means for clamping an element to be tightened or loosened; means for turning the element clamped by the clamping means; a fluid operated drive means formed to act on said clamping means and on said turning means so that under the action of said fluid operated drive means said clamping means clamp the element and then said turning means turn the clamped element, said fluid operated drive means including a first fluid operated cylinder-piston unit provided with a first piston which acts on said clamping means and a second fluid operated cylinder-piston unit provided with a second piston which acts on said turning means; means for communicating said fluid operated cylinder-piston units with a source of a working fluid and with one another so that the working fluid is first supplied into said first fluid operated cylinder-piston unit to act first on said first piston and therefore first to clamp the element, and then to said second fluid operated cylinder-piston unit so as to subsequently act on said second piston and therefore to subsequently turn the clamped element, said communicating means including a first passage leading from a source of the working fluid to said first cylinder-piston unit, a second passage communicating said fluid operated cylinder-piston units with one another; and a valve arranged in said second passage and formed so as to open only when a pressure of the working fluid reaches a predetermined level after clamping of the element.

2. A fluid operated tool for tightening and loosening an element, comprising means for clamping an element to be tightened or loosened; means for turning the element clamped by the clamping means, said clamping means including a substantially stationary clamping part and a moveable clamping part which moves relative to said stationary clamping part so as to clamp the element, said movable clamping part being a part of said clamping means while said stationary clamping part is connected with said turning means; and a fluid operated drive means formed to act on said clamping means and on said turning means so that under the action of said fluid operated drive means said clamping means clamp the element and then said turning means turn the clamped element, said fluid operated drive means including a first fluid operated cylinder-piston unit provided with a first piston which acts on said clamping means and a second fluid operated cylinder-piston unit provided with a second piston which acts on said turning means, said movable clamping part being connected with said first piston of said first fluid operated cylinder-piston unit, said turning means including an arm which is connected with said second piston of said fluid operated cylinder-piston unit, said stationary clamping part being connected with said arm.

3. A working fluid operated tool for tightening and loosening an element, comprising means for clamping an element to be tightened or loosened; means for turning the element clamped by the clamping means; a working fluid operated drive means formed to act on said clamping means and on said turning means so that under the action of said working fluid operated drive means said clamping means clamp the element and then said turning means turn the clamped element, said working fluid operated drive means including a first upstream working fluid operated cylinder-piston unit connectable with a working fluid source and provided with a first cylinder and a first piston movable in said cylinder and acting on said clamping means and a second downstream working fluid operated cylinder-piston unit provided with a second cylinder which communicates with said first cylinder and also provided with a second piston which moves in said second cylinder and acts on said turning means so that the working fluid first flows to said first cylinder and then from said first cylinder to said second cylinder; and means allowing a flow of the working fluid from said first cylinder to said second cylinder only when a pressure of the working fluid reaches a predetermined level after clamping of the element.

4. A fluid operated tool as defined in claim 3; and further comprising means for communicating said fluid operated cylinder-piston units with a source of a working fluid and with one another so that the working fluid is first supplied into said first fluid operated cylinder-piston unit to act first on said first piston and therefore first to clamp the element, and then to said second fluid operated cylinder-piston unit so as to subsequently act on said second piston and therefore to subsequently turn the clamped element.

5. A fluid operated tool as defined in claim 3, wherein said clamping means includes a substantially stationary clamping part and a moveable clamping part which moves relative to said stationary clamping part so as to clamp the element.

6. A fluid operated tool as defined in claim 5, wherein said movable clamping part is a part of said clamping means while said movable clamping part is connected with said turning means.

* * * * *